US005086935A

United States Patent [19]

Gallagher

[11] Patent Number: 5,086,935

[45] Date of Patent: Feb. 11, 1992

[54] DISPENSING RACK WITH MOVABLY POSITIONABLE HANGERS

[76] Inventor: David Gallagher, 10858 Cedar Bend, Minnetonka, Minn. 55343

[21] Appl. No.: 603,893

[22] Filed: Oct. 26, 1990

[51] Int. Cl.[5] ..... A47F 5/00

[52] U.S. Cl. ..... 211/103; 211/59.1; 211/121

[58] Field of Search ..... 211/1.5, 121, 207, 59.1, 211/57.1, 122

[56] References Cited

U.S. PATENT DOCUMENTS

| | | | |
|---|---|---|---|
| 327,000 | 9/1885 | Marshall et al. . | |
| 1,013,015 | 12/1911 | Herman . | |
| 2,669,799 | 3/1951 | Stiteler . | |
| 2,976,100 | 3/1961 | Wigley . | |
| 3,785,501 | 1/1974 | Canning | 211/57.1 X |
| 3,893,741 | 7/1975 | Schick . | |
| 4,026,617 | 5/1977 | Bosio et al. . | |
| 4,120,546 | 10/1978 | Veigel . | |
| 4,191,435 | 3/1980 | Lehman . | |
| 4,296,984 | 10/1981 | Lehman . | |

*Primary Examiner*—Robert W. Gibson, Jr.
*Attorney, Agent, or Firm*—Haugen and Nikolai

[57] ABSTRACT

A merchandise storing and dispensing rack means comprising a frame, shroud means, and an endless merchandise display supporting belt trained about toothed drive and idler rollers, each of which is journaled for rotation about generally parallelly arranged spaced-apart axes. Drive means are provided for powering the drive roller along with the merchandise loading and carrying means coupled to the endless merchandise display supporting belt. The endless belt is slotted as is the shroud means so as to permit passage of a support roller therethrough. The endless merchandise display supporting belt is further provided with bores for receiving the distal end of a drive bracket therein. Merchandise loading and carrying means are provided with an elongated generally "U"-shaped roller supported channel means with an outer rod receiving plate and a pair of laterally disposed roller supported legs extending from the rod receiving plate. A pair of spaced-apart channel supporting rollers are journably supported within the channels legs and are disposed to contact the surface of the shroud laterally of the belt receiving channel. A drive bracket is slidably secured to the shank of the merchandise loading and carrying means at its proximal end, and has its distal end received in one of the drive bracket receiving bores of the endless belt. An additional roller is journably secured to the distal end of the centrally disposed rod of the loading and carrying means, and is adapted to be positioned with its axis generally parallel to the axes of the channel supporting rollers. A biasing means is provided to normally bias the additional roller into contact with the inner surface of the shroud means in a position opposed to the belt receiving channel.

3 Claims, 4 Drawing Sheets

DISPENSING RACK WITH MOVABLY POSITIONABLE HANGERS

BACKGROUND OF THE INVENTION

The present invention relates generally to an improved merchandise dispensing rack, and more particularly to a merchandise dispensing rack having means for movably positioning by either raising or lowering display racks within a vertically positioned display system. The apparatus of the present invention finds particular utility in point-of-purchase display systems arranged at or along the upper surfaces of conventional merchandise display racks and stands.

Convenience stores are a rapidly growing segment of retail merchandising in the United States. Convenience stores are more commonly and more typically associated with retail gasoline outlets, or other facilities, and are arranged to accommodate purchasers on a convenience outlet basis. Convenience stores typically occupy relatively small areas, and hence it has become more and more desirable to utilize as much space as is possible, including that space which is above the level of the typical and/or normal retail display rack and/or stand. Utilization of this space permits a wider variety of merchandise to be stocked, displayed, and sold, thereby improving the efficiency of a retail convenience outlet store.

In order to achieve a proper balance between point-of-purchase display stands and the availability of such stands to the purchaser it has been found desirable to stack merchandise vertically, and arrange the merchandise on spaced-apart display racks. These racks may be movably positioned from time to time in order to replace merchandise that has been purchased by the customers, thereby permitting a relatively constant supply of material to be present, without requiring immediate and continuous stocking. The display racks of the present invention provide a means for adjustably positioning, by moving the display racks upwardly and/or downwardly in order to present the material to the customer at or approximately at eye level.

SUMMARY OF THE INVENTION

Briefly, in accordance with the present invention, a merchandise dispensing rack is provided which comprises a frame supporting means, shroud means, and an endless merchandise display supporting belt trained about spaced toothed drive and idler rollers. The drive roller is arranged to be powered by either manual or motor means, depending upon the application.

The arrangement of the merchandise dispensing rack means of the present invention provides for ease of accessibility, both to the purchaser, as well as to the store personnel charged with the duty of stocking such displays. The arrangement provides for ease of stocking as well as ease of access to the customer. More importantly, the arrangement further provides for use of otherwise wasted space, particularly at a point elevated from the zone conveniently accessible to the normal customer.

Therefore, it is a primary object of the present invention to provide an improved merchandise dispensing rack means which is provided with means for movably positioning merchandise, and furthermore with quick access to both stocking and removal by the customer.

It is yet a further object of the present invention to provide an improved merchandise dispensing rack means which permits a merchandise on display to be raised and/or lowered as required for ease of access of the merchandise to the customer.

It is yet further object of the present invention to provide an improved merchandise display rack which utilizes a endless belt for raising and/or lowering display racks, and furthermore for ease of removal of the racks to permit the endless belt to traverse its entire orbit.

Other and further objects of the present invention will become apparent to those skilled in the art upon a study of the following specification, appended claims, and accompanying drawings.

IN THE DRAWINGS

Figure 3:
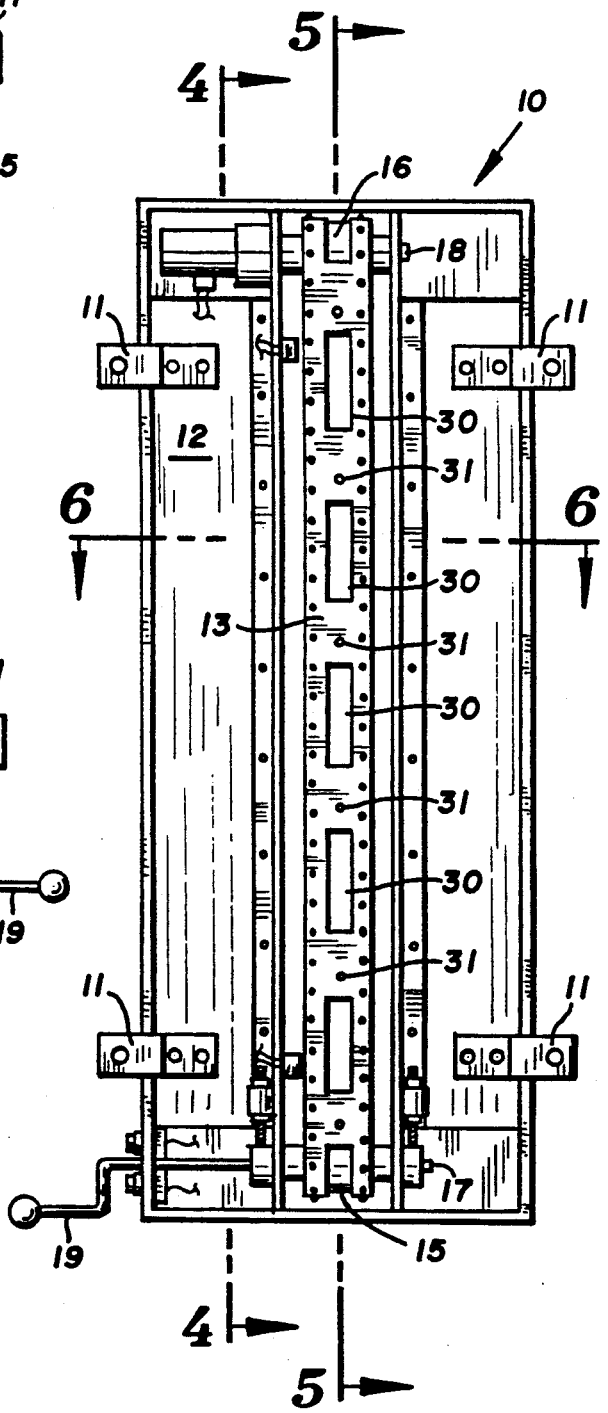
FIG. 3 is a rear elevational view of the apparatus illustrated in FIG. 1, and showing the details of the drive means for moving the endless belt throughout its orbit.
Figure 4:
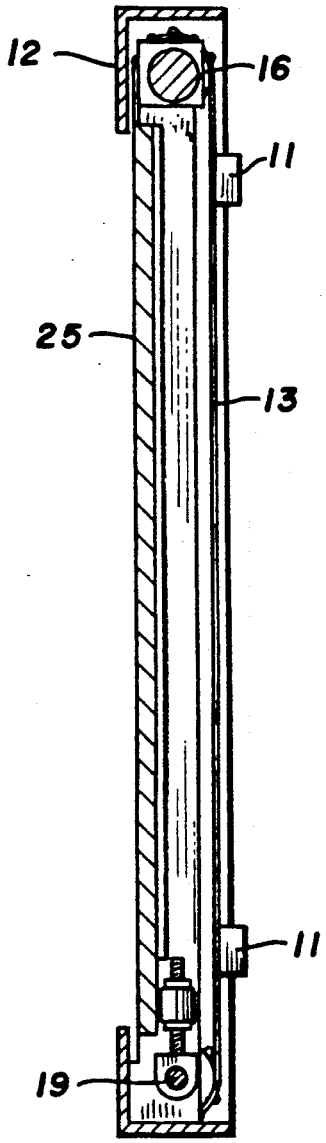
Figure 5:
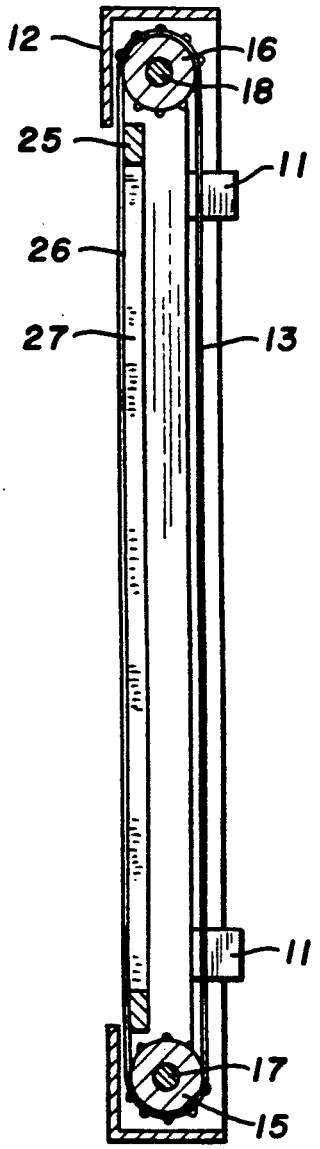
Figure 6:
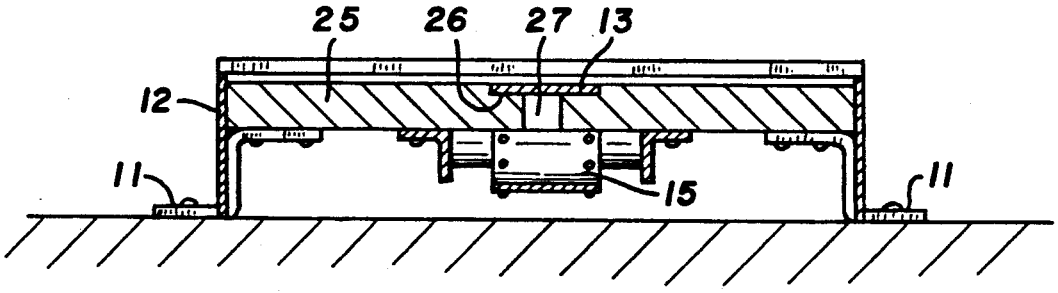
Figure 7:
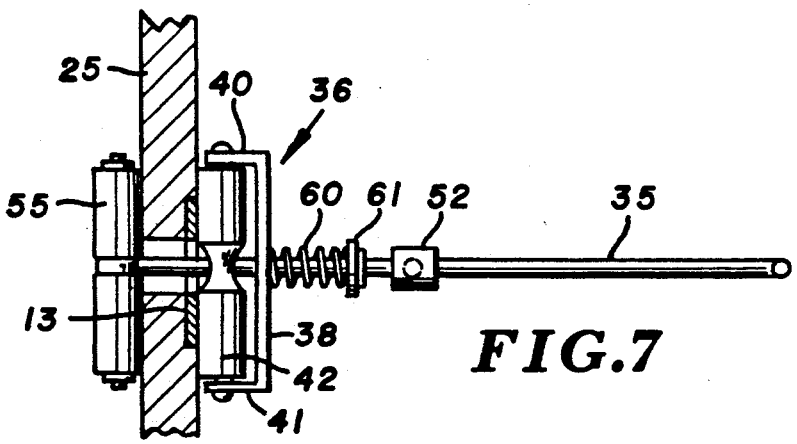
Figure 8:
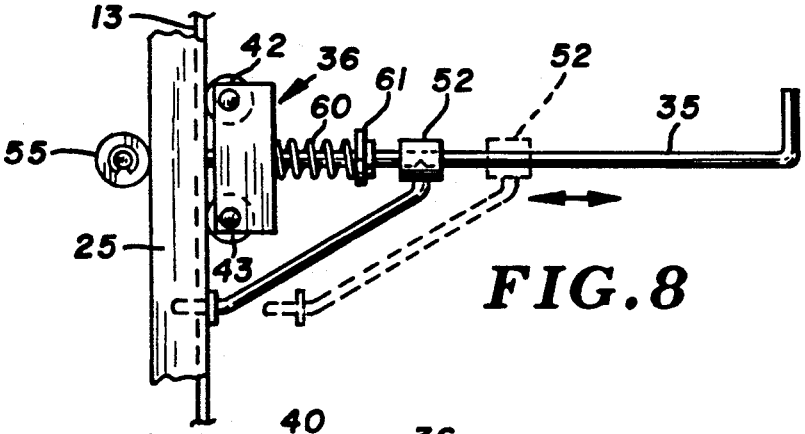
Figure 9:
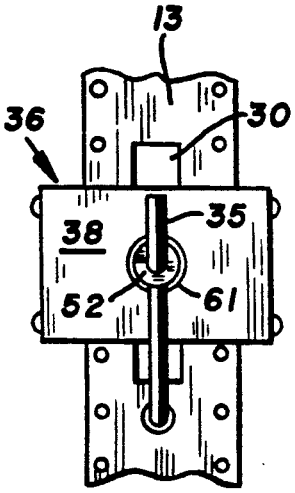
Figure 10:
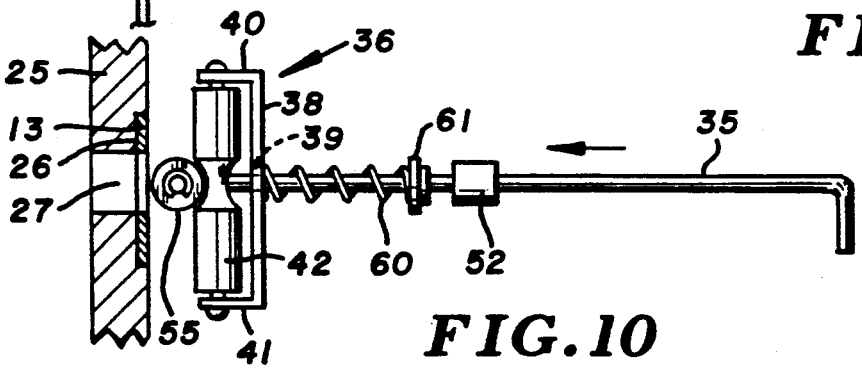
Figure 11:
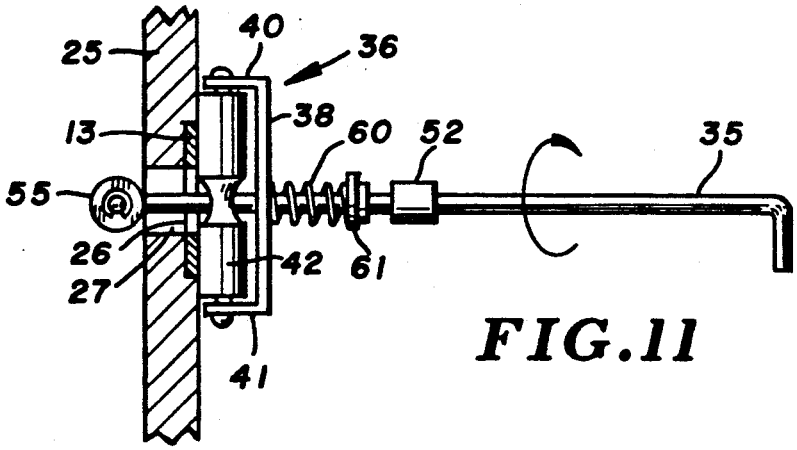

FIGS. 4 and 5 are vertical sectional views taken along the line and in the direction of the arrows 4—4 and 5—5 respectively of FIG. 3;

FIG. 6 is a horizontal sectional view taken along the line and in the direction of the arrows 6—6 of FIG. 3;

FIG. 7 is a partial fragmentary top view of the endless belt and merchandise loading and carrying devices arranged in accordance with the present invention, with FIG. 7 being shown on a slightly enlarged scale;

FIG. 8 is a partial fragmentary side view of that portion of the device illustrated in FIG. 7, with FIG. 8 being shown on a slightly enlarged scale;

FIG. 9 is a partial fragmentary end view of that portion of the device illustrated in FIG. 7, with FIG. 9 being shown on a slightly enlarged scale;

FIG. 10 is a view similar to FIG. 7, and illustrating the merchandise loading and carrying means turned at 90° for installation of the rear roller portion through the slot formed in the endless belt and panel, with FIG. 10 being shown on a slightly enlarged scale; and FIG. 11 is a view similar to FIG. 10, and illustrating the rack with the roller inserted through the slots formed in the endless belt and shroud means, and about to be rotated 90° into its operative disposition, with FIG. 11 being shown on a slightly enlarged scale.

DESCRIPTION OF THE PREFERRED EMBODIMENT

Figure 1:
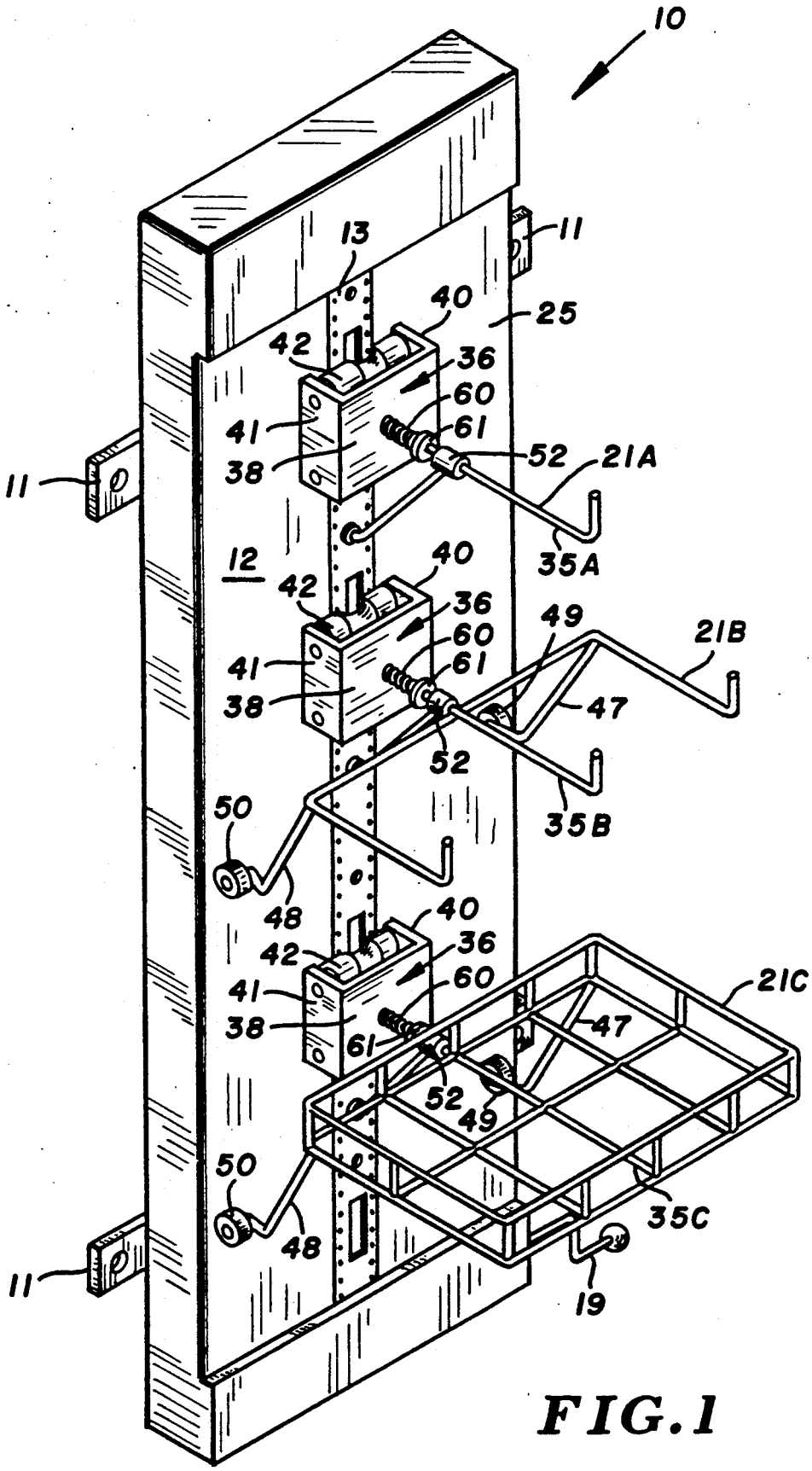
FIG. 1 is a perspective view of the front surface of the merchandise dispensing rack of the present invention, and illustrating three different forms of merchandise loading brackets useful in connection with the structure.
Figure 2:
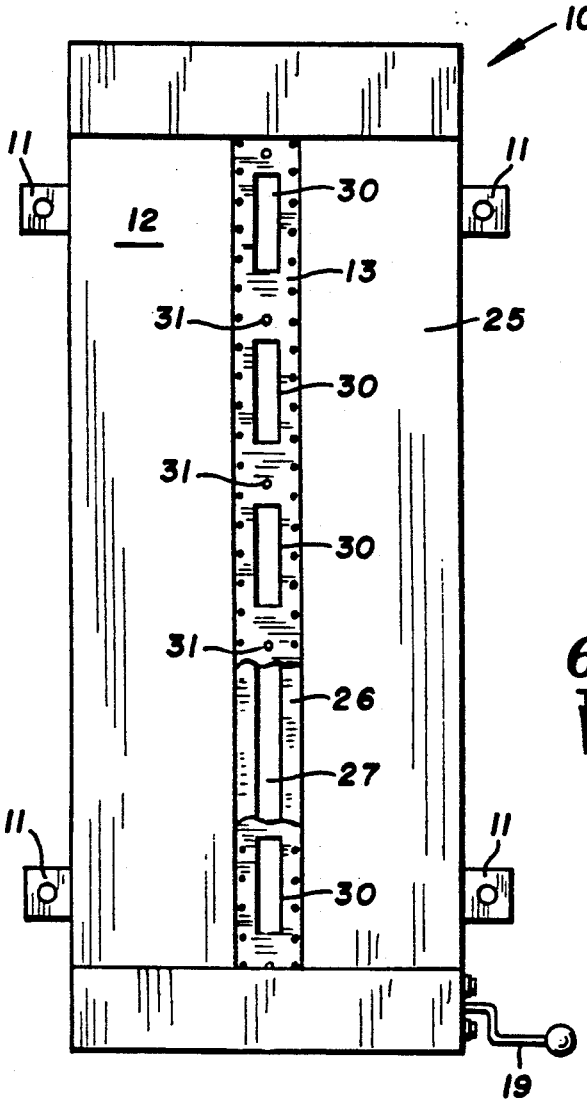
FIG. 2 is a front elevational view, with a portion of the endless belt being cut away, and with the racks removed from the structure illustrated in FIG. 1.

In accordance with the preferred embodiment of the present invention, and with particular attention being directed to FIGS. 1 and 2 of the drawings, the merchandise storing and dispensing rack means generally designated 10 comprises frame supporting means as at 11—11, along with shroud means shown generally at 12. An endless merchandise display supporting belt 13 is shown, with the display belt being trained about toothed drive and idler rollers shown in FIG. 3 at 15 and 16 respectively. Rollers 15 and 16 may also be referred to conveniently as film-type sprockets, with each being journaled for rotation about generally parallel spaced-apart axes as at 17 and 18 respectively. Drive means are provided for powering the drive roller 17, such as illustrated in the hand crank 19.

Merchandise loading and carrying means such as shown at 21A, 21B, and 21C are provided, with the term "rack" being used in a comprehensive sense, and being intended to refer to the single hook element of 21A, the multiple hook or rack style of 21B, or the basket arrangement as illustrated at 21C.

The shroud means 12 has an outwardly facing panel as shown at 25, with a belt receiving channel being formed therein, as being shown at 26 in FIGS. 5 and 6. A slot is formed in the recessed or channel as at 27, with the slot 27 being designed to permit a roller member to be inserted therethrough, as will be described hereinafter. In this arrangement, as is indicated, the endless display supporting belt 13 is disposed for running movemen within the shroud channel, thereby permitting orbital movement of the belt over the toothed drive and idler rollers 17 and 18 respectively.

Endless display supporting belt 13 has a plurality of axially spaced-apart roller receiving slots 30—30 formed therein. These slots 30—30 are arranged in axial alignment with slot 27 formed in panel 25. Additionally, a plurality of drive bracket receiving bores 31—31 are formed in belt 13, the purpose of the bores 31—31 being to receive a supporting bracket therewithin, as will be described hereinafter.

Merchandise loading and carrying means such as illustrated at either of 21A, 21B, or 21C are provided, each of which has a load receiving rod means such as at 35A, 35B, and 35C respectively. Rod means 35A, 35B and/or 35C each comprise a centrally disposed support rod extending rearwardly of the merchandise loading and carrying means, and are arranged to be releasably coupled to the endless belt 13. Each such support rod is coupled to an elongated generally "U"-shaped roller supported channel means 36—36, with the channel means further comprising and including an outer rod receiving plate such as at 38-38. A rod receiving guide bore is formed within each plate 38, such as is shown at 39 in FIG. 10. A pair of laterally disposed roller supported legs 40 and 41 complete the "U"-shaped roller supported channel means. Rollers such as are shown at 42 and 43 (FIG. 8) are provided for the roller support, with rollers 42 and 43 being journably supported within the oppositely disposed legs 40 and 41.

The rollers 42 and 43 are designed to contact the surface of the shroud laterally of the belt receiving channel 26 formed within the shroud.

With attention now being directed to the embodiments of merchandise loading and carrying means 21B and 21C, it will be noted that a pair of lateral guide brackets are secured to the loading and carrying means adjacent the opposed lateral ends thereof, such as at 47 and 48. These brackets provide a suitable mount for stabilizing wheels or rollers 49 and 50, which are arranged to make stabilizing contact with the surface of shroud member 25 and provide lateral stability to the merchandise loading and carrying means 21A—21C respectively. As indicated in the drawings, stabilizing wheels 49 and 50 are journaled for rotation along the distal ends of members 47 and 48 respectively, thereby providing for rotational contact between wheels or rollers 49 and 50 on the surface of shroud 25. These stabilizing wheels are arranged laterally outwardly of the roller supported "U"-shaped channel means 36. A drive bracket is slidably secured to the shank of the rod 35A, or alternatively to rods 35B and/or 35C, with this drive bracket including sleeve 52 being coupled to its proximal end. At the distal end of each of the rods 35, including 35A, 35B and 35C, there is provided a distal end which is received within one of the drive bracket receiving bores such as shown at 31—31. In this fashion, the drive bracket provides stability and support for the merchandise loading and carrying means.

An additional roller, such as illustrated at 55 in FIGS. 7, 8, 10 and 11 is journably secured to the distal end of each of the rods 35, including rods 35A, 35B, and 35C. Each of the rollers 55—55 is adapted to be operably disposed parallel to the channel supporting rollers 42 and 43, and is preferably positioned midway between the bores or rollers 42 and 43. Ideally, the journals for each of the rollers 42, 43, and 55 form three points of an equilateral or isosceles triangle, with the distance between journals for roller 55 being equally distant from the rollers 42 and 43 respectively. Furthermore, the roller 55 has a length and diameter which is less than the length and diameter of the roller receiving slot formed in belt 13, as well as the width of the slot 27 formed within shroud 25. This enables passage of the roller 55 through the slot for supporting "U"-shaped channel means appropriately.

Resilient biasing means such as spring and collar 60 and 61 respectively are provided to normally bias the roller 55 into contact with the inner surface of shroud panel 25. This arrangement is illustrated in detail in FIGS. 7 and 8, as well as in FIGS. 10 and 11.

It will be appreciated, therefore, that in operation, the store personnel stocking the display apparatus with merchandise will load the individual members 21, including 21A, 21B and/or 21C, as appropriate, with merchandise. As the merchandise becomes exhausted from the lowermost member, the store personnel may simply actuate the power means shown at 19 to raise and/or lower the endless belt, and thus achieve positioning of the merchandise at or about the customer's eye level. During slack periods of time, the stocking personnel may reload the apparatus as needed in order to appropriately match product supply with product demand.

While the apparatus illustrated in the drawings suggests three superimposed accessible and visible stations, structure 10 may be elongated to any appropriate length so as to provide a substantially greater number of stations, as may be accommodated and/or required.

What is claimed is:

1. In a merchandise storing and dispensing rack means comprising frame supporting means, shroud means, and an endless merchandise display supporting belt trained about toothed drive and idler rollers, each of which is journaled for rotation about generally parallel spaced-apart axes, and with drive means for powering said drive roller, and merchandise loading and carrying means coupled to said endless display supporting belt, said merchandise display rack means being characterized in that;

(a) said shroud means having an outwardly facing panel with a slotted belt receiving channel formed therein, said endless display supporting belt disposed for running movement within said shroud channel and having a plurality of axially spaced-apart roller receiving slots and drive bracket receiving bores formed therein;

(b) merchandise loading and carrying means having a merchandise load receiving rod means including a centrally disposed support rod extending rearwardly of said merchandise loading and carrying means and arranged to be releasably coupled to s id belt and further comprising a elongated generally "U"-shaped roller supported channel means with an outer rod receiving plate with a rod receiving guide bore formed therein, and a pair of laterally disposed roller supported legs extending from said rod receiving plate;

(c) a pair of spaced apart channel supporting rollers journably supported across said roller supported legs and disposed to contact the surface of said shroud laterally of said belt receiving channel;

(d) a drive bracket slidably secured to the shank of said centrally disposed rod at its proximal end and having its distal end received within one of said drive bracket receiving bores; and (e) an additional roller journably secured to the distal end of said centrally disposed rod adapted to be operably disposed parallel to said channel supporting rollers, and having a length and diameter which is less than the length and diameter of said roller receiving slot so as to enable passage of said roller through said slot, and resilient biasing means arranged radially outwardly of said centrally disposed rod and normally biasing said third roller into contact with the surface of said shroud means opposed to said belt receiving channel.

2. The merchandise storing and dispensing rack means as defined in claim 1 being particularly characterized in that a pair of lateral guide brackets secured to said loading and carrying means adjacent the opposed lateral ends thereof and having roller means journaled therein for rotational contact with the surface of said shroud laterally outwardly of said roller supported channel.

3. The merchandise storing and dispensing rack means as defined in claim 2 being particularly characterized in that said lateral guide brackets are secured to said loading and carrying means at opposed lateral ends thereof.

* * * * *